United States Patent [19]

Gartner

[11] 3,991,596

[45] Nov. 16, 1976

[54] TUMBLER WHEEL, CHANGEABLE COMBINATION KEY LOCK CONSTRUCTION

[75] Inventor: Klaus W. Gartner, Downey, Calif.

[73] Assignee: Sargent & Greenleaf, Inc., Nicholasville, Ky.

[22] Filed: Jan. 30, 1976

[21] Appl. No.: 653,890

[52] U.S. Cl. ..... 70/303 A; 70/322; 70/355

[51] Int. Cl.[2] ..... E05B 37/08

[58] Field of Search ..... 70/284, 285, 303 R, 70/303 A, 316, 317, 321, 322, 355, 366, 382, 383, 384

[56] References Cited

UNITED STATES PATENTS

| | | | |
|---|---|---|---|
| 1,484,692 | 2/1924 | Weber | 70/323 X |
| 1,956,304 | 4/1934 | Abbott et al. | 70/317 |
| 2,494,575 | 1/1950 | O'Brien | 70/317 X |
| 3,045,466 | 7/1962 | Herlong | 70/303 A |
| 3,373,583 | 3/1968 | Parrack | 70/303 R |
| 3,514,982 | 6/1970 | Bergendahl | 70/384 X |
| 3,906,761 | 8/1974 | Swaim | 70/303 A |
| 3,968,667 | 7/1976 | Gartner et al. | 70/303 A |

FOREIGN PATENTS OR APPLICATIONS

| | | | |
|---|---|---|---|
| 201,738 | 5/1956 | Australia | 70/333 |
| 507,545 | 11/1954 | Canada | 70/303 A |
| 426,272 | 11/1924 | Germany | 70/317 |
| 813,817 | 9/1951 | Germany | 70/355 |
| 168,173 | 4/1951 | Germany | 70/355 |
| 735,148 | 8/1955 | United Kingdom | 70/303 A |

*Primary Examiner*—Roy D. Frazier
*Assistant Examiner*—Thomas J. Holko
*Attorney, Agent, or Firm*—Mason, Fenwick & Lawrence

[57] ABSTRACT

A tumbler wheel type lock mechanism for use in key locks, dial operated combination locks and the like, including plural tumbler wheels in a lock casing having gated rim portions encircling hub portions which may be adjusted to different angular positions relative to their associated rim portions. A pivoted fence lever is normally releasably latched in a raised inactive position, and a releasing spring is activated by a control cam to impact against a shoulder formation on the fence lever for releasing the latter from such latched condition and impelling it to coupled relation with the control cam when the tumbler wheels occupy a predetermined alignment whereby the lock cam can be unlocked by operation of the control cam.

14 Claims, 6 Drawing Figures

TUMBLER WHEEL, CHANGEABLE COMBINATION KEY LOCK CONSTRUCTION

BACKGROUND AND OBJECTS OF THE INVENTION

The present invention relates in general to tumbler wheel lock mechanisms suitable for changeable key operated locks and dial operated combination locks, and more particularly in one example to changeable key locks of the type having a plurality of peripherally gated tumbler wheels with changeable hub portions adapted to be conditioned upon manipulation of a key inserted therein to assume positions appropriate to the salients or wards of the particular key therein for setting the lock to the key configuration.

Conventional key locks usually employ pivoted lever tumblers or axially slidable pin tumblers to engage the contoured edge of the key blade and adjust the lever tumblers or pin tumblers to positions releasing the lock to a condition so that the bolt can be retracted. These key operated locks are usually of an entirely different construction and operate in accordance with different principles from conventional locks of the class known as combination locks. Combination locks usually comprise three or more tumbler wheels which are loosely journalled in coaxial, side-by-side spaced relation for rotation within a lock casing on a tubular arbor or tumbler post projecting inwardly from the front wall of the casing. The lock dial, which usually has one hundred peripheral calibration marks thereon, is affixed to a dial spindle which extends through the bore of the tumbler post and has keyed to the inner end thereof a disc-like drive cam which is likewise arranged coaxially with and spaced rearwardly from the tumbler wheels. A drive pin projects forwardly from the drive cam and has a lost motion connection through a conventional fly with the rearmost tumbler wheel to drive the tumbler wheel in selected relation to the drive cam. A similar lost motion connection is provided between each of the successive tumbler wheels so that each of the tumbler wheels may be driven upon predetermined rotation of the drive cam to position the peripheral notch or gate in each of the tumbler wheels in alignment to receive a fence projecting laterally from a fence lever in overlying relation with the tumbler wheel peripheries. The position of the fence in relation to the length of the fence lever nose is usually such that the fence is slightly spaced from the peripheries of the tumblers when the fence lever nose rides on the periphery of the drive cam.

An object of the present invention is the provision of a novel lock construction for key operated locks, particularly for use with keys of the European type having wards or salients projecting from diametrically opposite portions of the shaft or stem of the key, wherein the locking mechanism includes a plurality of peripherally gated tumbler wheels similar to the type employed in combination locks, coactive with a fence lever pivotally coupled to a sliding bolt and a fence lever controlling cam movable by the key when inserted into the lock casing, whereby the key can adjust the tumbler wheels to release the fence lever to a position coupling it with the cam for retracting the bolt to an unlocking position.

Another object of the present invention is the provision of a key lock construction of the type described in the immediately preceding paragraph, wherein the tumbler wheels are provided with hubs which are releasably coupled with the peripheral portions of the tumbler wheels and which are apertured and shouldered to receive the salient or ward portions of the key therein to be angularly adjusted thereby for disposing the tumbler wheels in position to release the lock to unlocking condition.

Another object of the present invention is the provision of a lock construction of the type described in the two immediately preceding paragraphs, wherein the positions of the hub portions of the tumbler wheels may be changed responsive to adjustment of a different key disposed therein from the one to which they were previously set, when the hubs are decoupled from the peripheral portions of the tumbler wheels, to adjust the tumbler wheel hubs to the salient or ward configuration of a different key.

Another object of the present invention is the provision of a key operated, rotatable tumbler wheel type lock of the type described in the preceding paragraphs, wherein the fence lever is normally releasably held in a position spacing the fence lever and fence out of contact with the associated cam and tumbler wheel peripheries and wherein spring means are periodically activated by adjustment of the cam responsive to movement of the key to store up energy in the spring means and then release the same suddenly to impel the fence lever to an unlocking position if the tumbler wheels are properly adjusted to release the lock.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
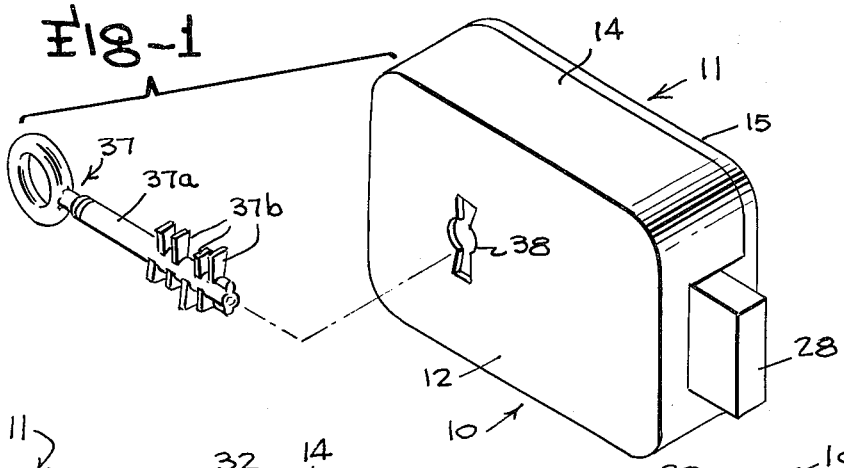
FIG. 1 is a front perspective view of a key lock constructed in accordance with the present invention.

Referring to the drawings, wherein like reference characters designate corresponding parts throughout the several figures, there is illustrated a key lock, generally indicated by the reference character 10, which comprises a substantially rectangular lock case 11 having a front wall 12 and rearwardly projecting end walls **13, 13*a* and top and bottom walls 14 and 14*a* defining a mechanism chamber therebetween which is rearwardly closed by a cover plate 15. The lock casing may be mounted against the inner surface of a door or other closure in the conventional manner, as by mounting screws extending through screw holes near the corners of the lock case and into the supporting door. Peripherally supported for rotary movement about their center axes by three tumbler supporting stationary wall segments 16, 17 and 18 projecting from the front wall 12 is a bank of side-by-side tumbler wheels 20, which rotate freely by sliding engagement of their peripheral surfaces with the inwardly facing or confronting surfaces of the tumbler wheel supporting segments 16–18. The tumbler wheels 20 generally resemble the changeable tumbler wheels usually employed in combination locks, in that they comprise an inner hub 21 having a serrated outer periphery which is engaged by similar teeth on the jaw formation 22 of a resilient interlocking lever 23 of peripheral or rim portions 24 of the tumbler wheels each having a tumbler gate or peripheral recess 20***a* therein. The outer annular rim portions 24 are selectively locked against rotation relative to their supporting hubs 21 by the interlocking levers 23 which in the illustrated embodiment are integral with the remainer of the rim portions 24 but are sufficiently narrow in the shank portions 23a of the levers 23 to permit the jaw portion 22 to be moved toward and away from the edge of the hub, and a change cam 25 is rotatably supported in each rim portion 24 of each tumbler wheel to be operated by a change key inserted through a non-round center opening in the change cam for normally holding the jaw portion 22 in locking relation with the serrated teeth of the hub and having a flat which may be positioned to allow the jaw portions of the interlock levers to resiliently return radially outwardly to unlock relation relative to the hub teeth. Thin spacer shims 26 in the form of curved yokes having lower legs 26*a* for restraining them on the lower supporting segment 18 are interposed between each side-by-side pair of tumbler wheels 20 to space the adjacent portions of side-by-side tumbler wheels out of contact with each other to prevent rotation of one tumbler wheel from being transmitted to the adjacent tumbler wheel.

The lock is provided with a bolt 28 which is adapted to slide in a suitable guideway formed in the end wall 13*a* of the lock casing. The bolt 28 is operated by means of a fence lever 29 which is pivotally attached to the bolt by a screw and is normally resiliently restrained in the elevated position shown in FIG. 2 by a knob formation 30 similar to the head of a snap fastener projecting upwardly from the fence lever and resiliently restrained in a spring socket member 31 coacting with the knob formation 30 in a manner similar to the manner in which a conventional socket component coacts with the head component of typical snap fasteners. The fence lever 29 is provided with a laterally projecting bar 32, commonly referred to as a fence, which projects along an axis parallel to the center axis of the tumbler wheels 20 and overlies the peripheries of all of the tumbler wheels. The fence 32 is adapted to be received in the peripheral gates 20*a* of the tumbler wheels 20 when the tumbler gates are disposed in registry with each other at a chosen angular position, indicated to be at the 12 o'clock position in the illustrated embodiment.

A fence lever control cam 34 is rotatably supported in the lock casing by a rear journal formation 34*b* journalled in a socket or cavity in the rear cover plate 15 and a forwardly projecting shank portion 34*c* which is slotted to receive the round shank 37*a* of a key 37 and has a forward end rotatably journalled in a cavity or socket in the rear surface of the case front wall 12 adjacent the key opening 38 therein. The control cam 34 is provided with a shaped fence lever gate portion

34*a* adapted to receive the nose formation 29*a* on the fence lever. As will be observed from the illustration of the control cam 34 in FIG. 2, control cam gate 34*a* had a pair of carefully shaped walls, one forming an inclined slightly convex wall portion for controlling the movement of the fence lever nose 29*a* into the control gate and therefore controlling the speed of approach of the fence 32 toward the tumbler wheel peripheries, and the other wall forming a shoulder for cooperating with a complementary shoulder on the fence lever nose to cause the fence lever to be shifted in a manner to retract the bolt 28 upon rotation of the control cam in a counterclockwise direction as viewed in FIG. 2.

Figure 2:
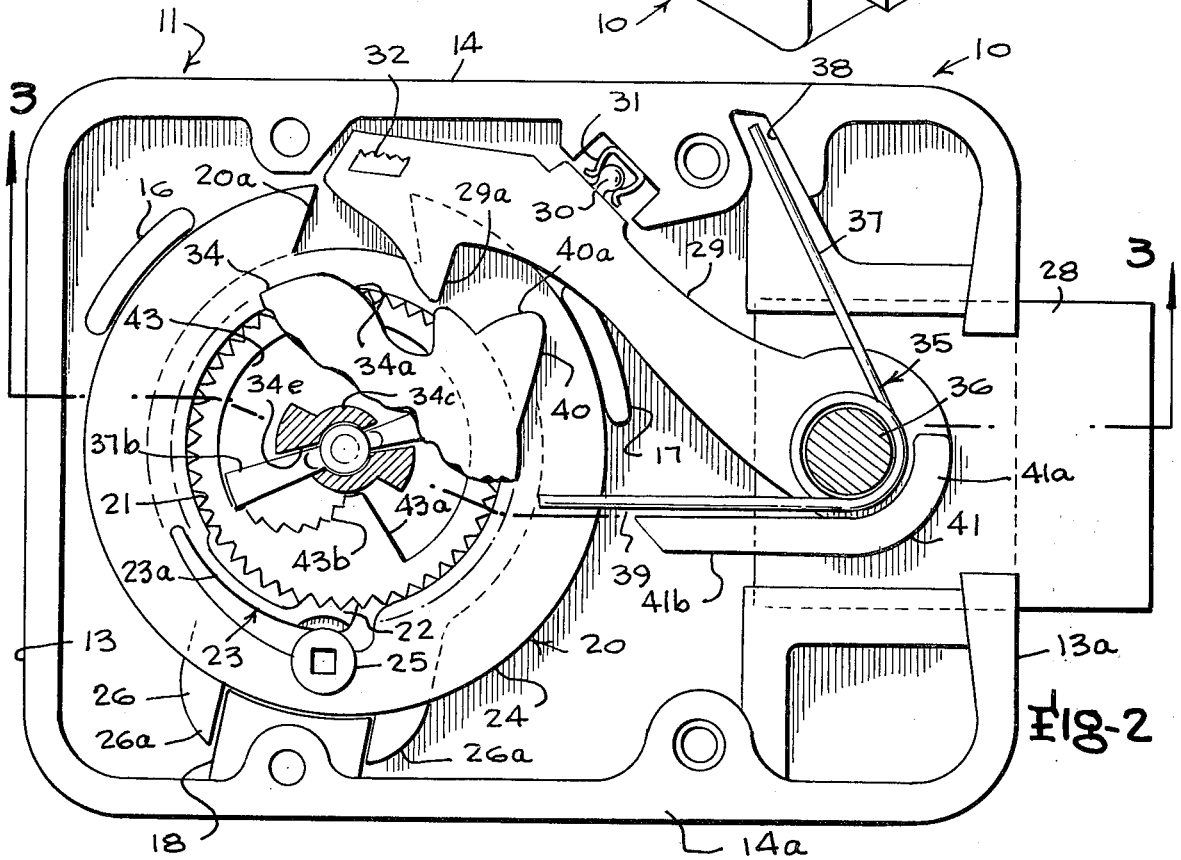
FIG. 2 is a rear elevation of the tumbler wheel type key lock, with the rear cover removed, and showing the lock in locked condition with the fence lever impacted toward the tumbler wheels with a tumbler misaligned.
Figure 3:
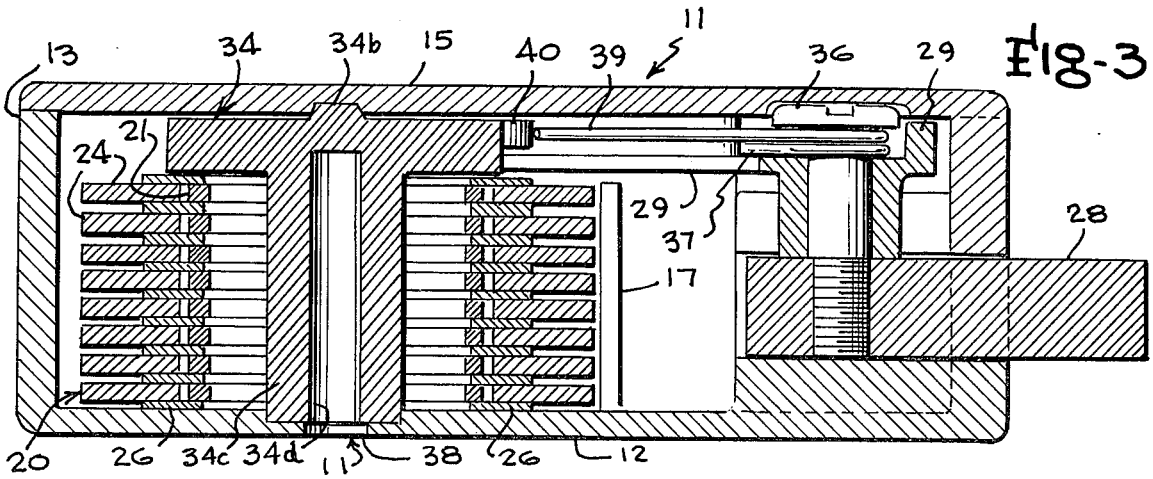
FIG. 3 is a horizontal section view, taken along line 3—3 of FIG. 2.
Figure 5:
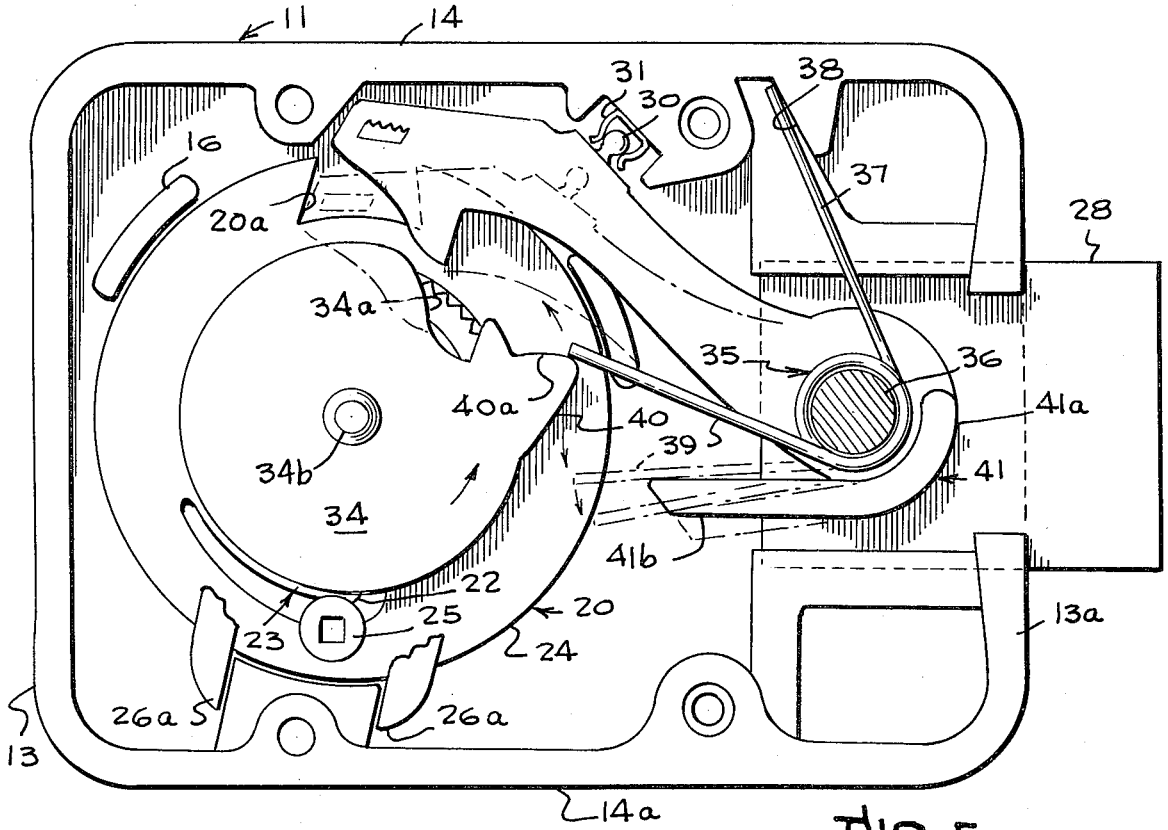
FIG. 5 is a rear elevation view similar to FIG. 2, with the control cam shown stressing the impelling spring.

The lock mechanism of the present invention includes structure, formed by the resilient stationary snap socket member 31 for capturing the snap head or knob formation 30 on the fence lever to normally retain the fence lever 29 and fence 32 in an elevated inactive position illustrated in FIG. 2 wherein the fence lever nose and fence are spaced out of contact with the control cam and tumbler wheel peripheries. The lock also includes structure enabling the operator to impel the fence lever 29 and fence 32 toward the control cam and tumbler wheels responsive to predetermined manipulation of the control cam in a manner to release the fence lever from held relation by the snap socket formation 31 and permit the fence to be fully seated in the tumbler wheel gates if the tumbler wheel gates are properly aligned to receive the fence, and to continue to cause the fence lever to be held in the raised inactive position if the gates are not properly aligned to receive the fence 32. The mechanism for impelling the fence lever 29 and its fence 32 toward the control cam and tumbler wheels comprises a lever actuator spring 35 in the form of a tortion spring having a center portion which encircles the pivot screw 36 mounting the fence lever 29 on the bolt 28 and having a first leg 37 extending along an upwardly inclined path and terminating in an end portion held in a socket 38 in the top wall 14 of the lock case to fix the end of the leg 37 in position, and having a second leg 39, which is the active leg of the spring, which normally extends substantially horizontally from the pivot screw 36 toward the centers of the tumbler wheels into the path of a spring actuating projection or lug formation 40 on the periphery of the control cam 34. The active second leg 39 of the spring 35 lies closely adjacent and spaced just above a shoulder formation 41 on the fence lever 29 which includes a curved portion 41*a* extending about part of the curved center portion of the spring 35 encircling the pivot screw 36 and an integral elongated shoulder extension 41*b* resembling a shelf formation underlying a substantial portion of the length of the second spring leg 39. The shape of the spring actuating projection 40 on the periphery of the control cam 34 is so correlated to the length and normal position of the second spring leg 39 that the end portion of the spring leg 39 is engaged by the rounded leading edge wall 40*a* of the actuating projection 40 as the control cam is rotated counterclockwise from below the FIG. 5 position toward the FIG. 2 position, causing the spring leg 39 to be stressed upwardly, consequently storing energy in the spring 35, until the end of the spring leg 39 rides off of the outermost end of the leading edge surface 40*a* of projection 40 whereupon the spring leg 39 is immediately freed to spring downwardly through its normal unstressed position illustrated in FIG. 2 and through a slight amount of overtravel, causing the spring leg 39 to impact with the upwardly facing surface of the shoulder extension portion 41*b* on the fence lever 29. This impacting of the spring leg 39 with the portion 41*b* of the shoulder formation 41 propels the fence lever 29 in a counterclockwise direction as viewed in FIG. 2 with sufficient force to release the snap head formation 30 from the snap socket formation 31 if the tumbler wheel gates 20*a* are all properly lined up to receive the fence 32. At this time of release of the spring leg 39 from the actuating projection 40 to impact upon the shoulder formation 41, the control cam gate 34*a* is properly positioned to receive the fence lever nose 29*a*, due to proper shaping of the projection 40 and proper circumferential spacing of the projection 40 from the control cam gate 34*a*. However, if any one of the tumbler wheel gates 40*a* is not properly positioned to receive the fence 32, the lower surface of the fence 32 abuts the periphery of that tumbler wheel during the initial part of the counterclockwise movement of the fence lever 29 responsive to the impact of the spring leg 39 on the shoulder 41, and this contact of the fence with the tumbler periphery occurs before the snap head formation 30 is fully released from the snap socket formation 31, so that the spring force in the side walls of the snap socket formation 31 on the confronting surfaces of the head 30 returns the head 30 into fully seated relation in the socket formation 31 and consequently withdraws the fence lever and fence to their normal inactive position spaced from the control cam and tumbler wheel peripheries.

Figure 4:
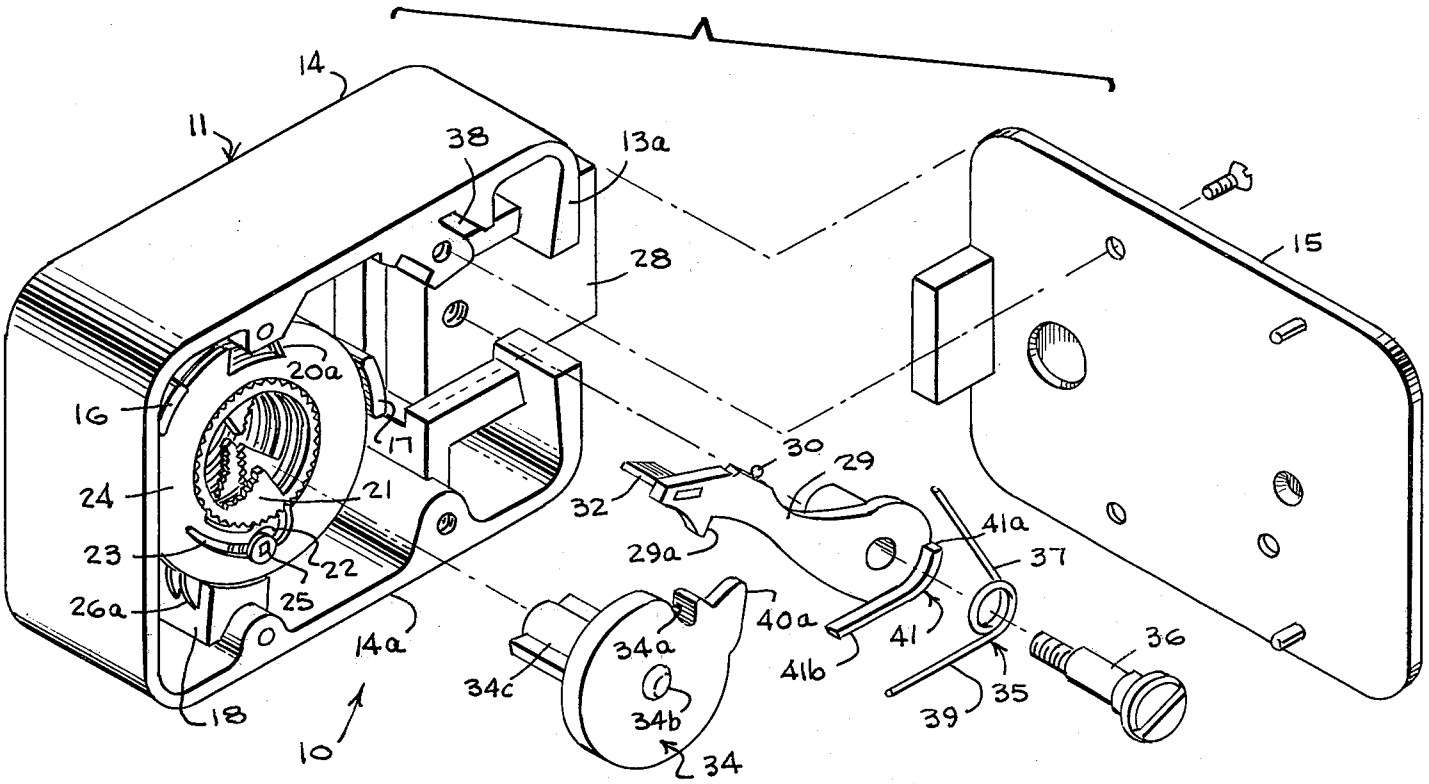
FIG. 4 is a rear partially exploded perspective view of the key lock.

In the key operated lock construction illustrated in FIGS. 1–5, the center shank 34*c* of the control cam 34 has a circular center bore 34*a* to receive the round shank of the key 37 and a pair of diametrically opposite slots 34*d* providing openings through which the wards or salients 37*b* on the key shank can project into the shaped apertures 43 in the hubs 21 of the tumbler wheel assemblies 20. These shaped apertures 43 in the hubs 21, the shape of which is best shown in FIGS. 2 and 4, are all of the same configuration, in the illustrated embodiment, and are contoured to provide a large circular opening extending through about three quadrants having a radius slightly greater than the radius of the longest key wards 37*b* to be provided on any keys usable with the lock and terminate in a straight radial shoulder 43*a* at one side of the opening 43 to be engaged by the key wards 37*b* upon clockwise rotation of the key, as viewed in FIG. 2, and having a stepped shoulder 43*b* at the other side of the opening 43 to be engaged by the key wards 37*b* upon counterclockwise rotation of the key as viewed in FIG. 2. The stepped shoulders or sides 43*b* of the shaped hub apertures 43 progress in radial step increments from a maximum radial dimension for the key wards to a minimum radial dimension for the key wards in accordance with the customary incremental steps in the radial sizes of key wards for such types of keys. The transition shoulders defined between the successive incremental radial steps making up the stepped shoulder 43*b* are spaced circumferentially from each other progressing in a clockwise direction from the largest radial segment, as viewed in FIG. 2, so that the circumferential or angular position of the hub 21 associated with each different radial length key ward will be slightly different. It will be apparent, therefore, that upon insertion of the key into the key aperture and rotation of the key in a counterclockwise direction as viewed in FIG. 2 to bring all of the key wards into abutment with the transition shoulder of the incremental step along shoulder 43*b* sized to correspond to the ward length will cause the hubs 21 to occupy different angular positions in accordance with the sizes of the key wards.

Reviewing briefly the operation of the lock, the lock mechanism is conditioned to respond to a particular key 37 by inserting through the change key opening in the rear cover 15 and into the square or non-round opening in the change cam 25, a combination change tool such as a bar of the same cross section as the non-round opening in the cam 25 and rotating the change tool to position the flat of the cam 25 toward the interlock lever 23, thereby allowing the lever 23 to flex the jaw formation 22 away from the teeth of the hub periphery 21, thereby releasing the hubs 21 for rotation independently of the rim portions 24 of the tumbler wheels 20. It will be assumed that the tumbler wheel rim portions 24 will have been previously positioned to align all of the change cams 25 with the change tool opening in the rear cover 15 of the lock case. The key to which the lock is to be conditioned is inserted fully into the key opening 36*a* of the control cam 34, and the key is then rotated in a counterclockwise direction as viewed in FIG. 2 through several revolutions to be sure that the wards 37*b* have each engaged the transition shoulder of the appropriate radial shoulder segment of the step shoulder 43*b* for that radial size ward, and such counterclockwise rotation of the key is continued until the key blade or handle is oriented in a particular direction, for example, by lining it up with the key entrance opening 38 or a mark associated therewith in a selected manner. With the key in this predetermined combination setting position, the change tool inserted in the openings in the change cams 25 is then rotated to position the change cams 25 so as to force the jaw formations 22 of the interlock levers 23 into locking relation with the teeth of the associated tumbler wheel hub 21, thereby fixing the angular position of the hub in its associated tumbler wheel rim portion in accordance with the radial size of the key ward which coacts with that hub. The change tool is then withdrawn from the openings in the aligned change cams 25 and the key is then rotated in a reverse or clockwise direction, as viewed in FIG. 2, to correspondingly rotate the control cam 34 clockwise, causing the shaped edge of the cam gate 34*a* engaging the nose 29*a* of the fence lever to raise the fence lever 29 to the elevated inactive position wherein the snap head formation 30 is seated in and resiliently retained in the socket formation 31. Continuing clockwise rotation of the key brings the wards 37*b* thereof into engagement with the straight radial shoulder 43*a* forming one side of the shaped apertures 43 in the hubs to, in effect, scramble the hubs and tumbler wheel rim portions assembled therewith so that the tumbler wheel gates 20*a* are no longer aligned with the fence 32 or with each other.

When it is desired to unlock the lock with the appropriate key, the key is simply inserted in the key opening 38 to fully seat the portion of the key having the wards 37*b* in the key opening 36*a* of the control cam, and the key is then rotated in a counterclockwise direction as viewed in FIG. 2 to bring the wards into engagement with the transition shoulders of the appropriate shoulder segments forming the step shoulder 43*b* whereby the tumbler wheels will all be angularly positioned relative to each other so that the gates 20*a* are all aligned with each other and are disposed so as to occupy a position, shown in FIG. 2, appropriate to receive the fence 32 when the control cam 34 occupies the position shown in FIG. 2 with the control cam gate 34*a* positioned to receive the fence lever nose 29*a* as the spring actuator projection 40 releases the spring 39 and applies the impact force to the fence lever impelling the fence lever toward the tumbler wheels. During the few degrees of rotation of the key, and therefore of the control cam 34, just before the gates 20*a* and 34*a* reach the position to receive the fence and fence lever nose, the curved leading surface 40*a* of the spring actuator projection 40 engaged the free end portion of the spring leg 39, as was previously described, stressing the spring leg 39 upwardly until released from engagement with the actuator projection 40 whereupon the return and overtravel movement of the spring leg 39 cause the spring to apply an impact force to the shoulder formation 41 on the fence lever 29, impelling the fence lever in a direction to seat the fence 32 in the gates 20*a* and the nose 29*a* in the gate 34*a*. If the gates 20*a* and 34*a* are properly aligned to receive the fence and fence lever nose, the snap head formation 30 becomes completely released from the snap socket formation 31 and the fence lever travels to release position, wherein the fence lever nose 29*a* is seated in the gate 34*a* and coupled with the control cam 34, whereby rotation of the key counterclockwise through a further small arc retracts the bolt 28. The bolt 28 is returned to projected position upon reverse rotation of the key and control cam 34, as the shape of the control cam gate 34*a* coacts with the fence lever nose to raise the fence lever back to the elevated inactive position shown in FIG. 2 upon clockwise rotation of the key, as viewed in FIG. 2, and the subsequent engagement of the key wards with the surface 43*a* of the hub openings 43, as the key is returned to the position to withdraw it from the key opening 38, scrambles the positions of the tumbler wheels so that the gates 20*a* are no longer in alignment with each other or with the fence 32.

Figure 6:
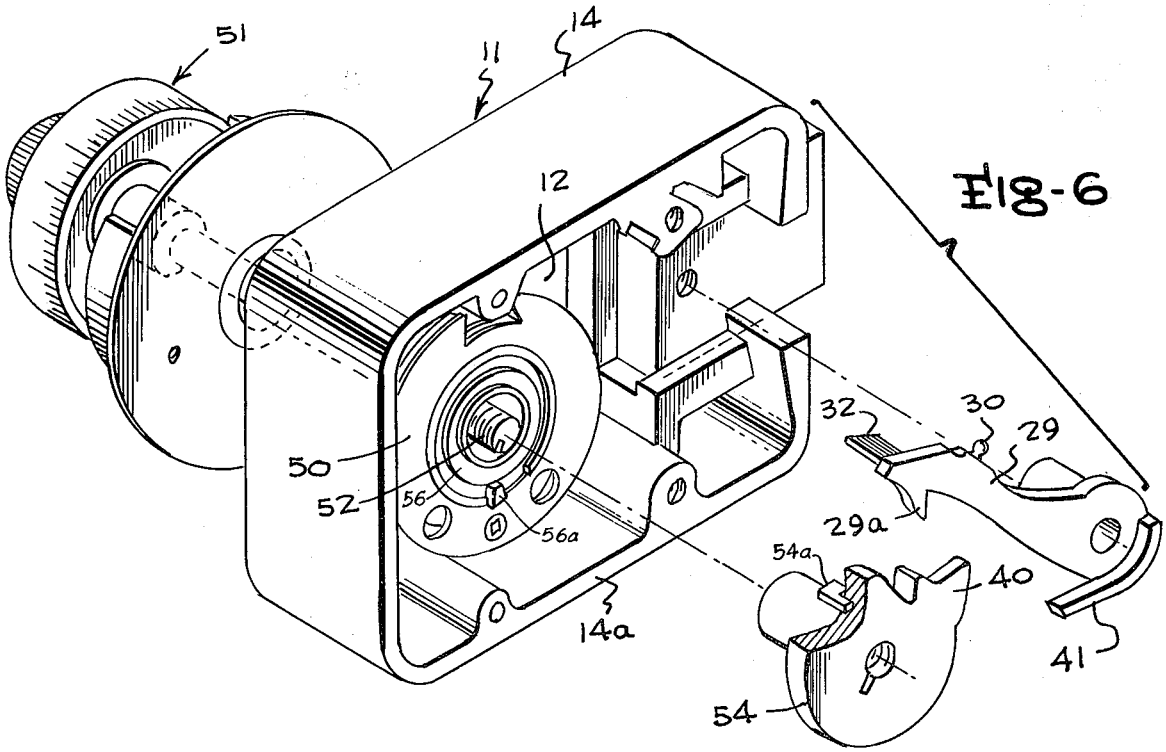
FIG. 6 is a fragmentary exploded perspective view of a dial operated combination lock embodying the present invention.

It will be appreciated that the same lock structure may be employed in a dial and knob operated combination lock of usual combination lock construction, by substituting for the pack of coaxial tumbler wheels 20 a pack of three conventional changeable coaxial tumbler wheels of the type normally used in combination locks, as indicated at 50 in FIG. 6, which are rotatably journalled on a hollow post extending integrally rearwardly from the front wall 12 of the lock case, and providing a dial and knob 51 fixed to a dial spindle 52 which extends through the bore of the hollow tumbler post and has a drive cam 54 shaped like the control cam 34 fixed to the rear end of the dial spindle and having a drive pin of conventional construction indicated at 54*a* projecting forwardly therefrom to engage a shoulder formation 56*a* on a fly the reference character 56 in the conventional manner associated with the rearmost tumbler wheel to provide the usual lost motion connection therebetween. In such a modified construction, forwardly projecting drive pins may also be provided on the rearmost and intermediate tumbler wheels to cooperate with similar flies associated with the next forwardmost tumbler wheel to provide the usual lost motion driving connection between successive tumbler wheels. Examples of changeable tumbler wheel assemblies having an outer gated rim portion and an inner serrated periphery hub, which may be used in the combination lock version of the present invention may be found in the prior Weber U.S. Pat. No. 1,484,692 or earlier Paul U.S. Pat. No. 3,254,519, it being understood that such tumbler wheel assemblies are well-known in the combination lock art.

In this version, it will be understood that the hubs of the tumbler wheel assemblies will not have shaped apertures like the shaped apertures 43 of the previously described key operated version, but will simply have drive pins and flies associated therewith to provide lost motion drive from the drive cam 54 in the manner customary in combination locks to angularly position the tumbler wheel hubs and their associated rim portions in the usual manner for combination locks. In such a combination lock version, it will be appreciated that each time the dial and drive cam are rotated through a sufficient arc to bring the spring actuator 40 into engagement with the spring leg 39 in the proper direction to stress the spring arm upwardly and then release it, causing impact during the spring overtravel with the fence lever shoulder 41, the fence lever 29 will be impelled toward the tumbler wheels, but the head formation 30 will not be moved sufficiently outwardly from its normal seated position in the socket formation 31 to release the fence lever therefrom until all of the tumbler wheel gates are properly positioned to receive the fence 32 and the drive cam is properly positioned to receive the fence lever nose 29*a* in the drive cam gate therefor.

In such a combination lock version, the combination is changed in the usual manner, by dialing the present combination in appropriate manner to align the openings in the change cams 25 with the change tool opening in the rear cover plate of the lock case, inserting the tool into the change cam openings and rotating the change cams to release the interlock levers from holding relation with the hubs, and dialing the new combination for the lock to establish new appropriate relative positions for the tumbler wheel hubs relative to the associated tumbler wheel rim portions, manipulating the change tool to adjust the change cams so as to return the interlock levers to locking relation with their associated hubs and withdrawing the tool from the case, whereupon the tumbler wheels will be reset to the new combinations.

What is claimed is:

1. A tumbler wheel type lock mechanism comprising a plurality of peripherally gated tumbler wheels supported for rotation about a common axis, a peripherally gated control cam rotatable about said axis, a bolt movable between projected and retracted positions, a fence lever having a fence and a depending nose and an abutment shoulder, means pivotally connecting the fence lever to the bolt for arcuate movement between a raised inactive position spacing the fence and nose out of contact with the tumbler wheel and control cam peripheries and a lowered active position locating the fence and nose in said gates, the control cam being operatively coupled to said nose at said active position for retracting the bolt upon predetermined rotation of the control cam, manually operable means for adjusting the angular positions of the tumbler wheels, coactive latching members for releasably latching said fence lever in said raised inactive position including a first latching member on the fence lever and a second latching member in the form of a stationary resilient latching element located at a fixed position above the fence lever to receive and releasably capture said first latching member and thereby hold the fence lever at said raised inactive position, a releasing spring adjacent said abutment shoulder having a movable leg capable of movement between a stressed spring energy storage position spaced from said shoulder and an impact position engaging the latter, the movable spring leg having a portion extending into the path of movement of a projection on the control cam for shifting said movable leg to the stressed position upon selective rotation of the control cam and said projection being shaped to release said movable leg from such stressed position for rapid spring driven movement to impact against said shoulder and impel the fonce lever toward the control cam to a position momentarily engaging the fence with the tumbler wheel peripheries without fully withdrawing said first latching member from the second latching member, the second latching member being operative to return the fence lever to said raised inactive position when the tumbler wheel gates are not aligned with the fence following the momentary engagement with a misaligned tumbler wheel periphery and the latching members being decoupled from each other to release the fence lever to said lowered active position responsive to such impelling of the fence lever toward the control cam when the tumbler wheel gates are properly aligned with the fence.

2. A lock mechanism as defined in claim 1, wherein said first latching member is an integral rigid ball-shaped head rising from the fence lever at a location spaced from the pivot connection with the bolt, and said second latching member is a socket member facing the head having opposite resilient wall portions for capturing the head therebetween and resiliently urging the head to fully seated relation in the socket.

3. A lock as defined in claim 2, forming a dial-operated combination lock, comprising a spindle rotatable about said common axis having said control cam on one end thereof and a manually operable dial on the other end for rotating the control cam to angularly adjust the tumbler wheels, and means providing a lost motion driving coupling between the control cam and the tumbler wheels.

4. A lock as defined in claim 2, wherein the lock is a key lock operable by a key having an elongated shank and a plurality of wards projecting therefrom insertable into the center portions of the tumbler wheels, said tumbler wheels each including center hub portions having shaped key apertures defining surfaces shaped to coact with the key wards to dispose said gates in alignment to receive the fence responsive to predetermined manipulation of the key.

5. A lock as defined in claim 4, wherein said tumbler wheels each include peripherally gated outer rim portions assembled on the center hub portions and interlocking lever means releasably interlocking the rim portions with the hub portions, and means for activating the interlocking levers to release the hub portions to assume different angular positions relative to their companion rim portions to permit resetting of the lock to different key ward configurations by resetting of relative positions of hub portions to their companion rim portions.

6. A lock mechanism as defined in claim 2, wherein said releasing spring includes an anchored leg extending at an angle to said movable leg and a midportion encircling the means pivotally connecting the fence lever to the bolt, and said movable leg extending alongside the fence lever in closely adjacent parallel relation to said abutment shoulder in the normal unstressed condition of the releasing spring.

7. A lock as defined in claim 6, wherein the lock is a key lock operable by a key having an elongated shank and a plurality of wards projecting therefrom insertable into the center portions of the tumbler wheels, said tumbler wheels each including center hub portions having shaped key apertures defining surfaces shaped to coact with the key wards to dispose said gates in alignment to receive the fence responsive to predetermined manipulation of the key.

8. A lock as defined in claim 7, wherein said tumbler wheels each include peripherally gated outer rim portions assembled on the center hub portions and interlocking lever means releasably interlocking the rim portions with the hub portions, and means for activating the interlocking levers to release the hub portions to assume different angular positions relative to their companion rim portions to permit resetting of the lock to different key ward configurations by resetting of relative positions of hub portions to their companion rim portions.

9. A lock as defined in claim 6 forming a dial-operated combination lock, comprising a spindle rotatable about said common axis having said control cam on one end thereof and a manually operable dial on the other end for rotating the control cam to angularly adjust the tumbler wheels, and means providing a lost motion driving coupling between the control cam and the tumbler wheels.

10. A lock as defined in claim 9, wherein said tumbler wheels each include peripherally gated outer rim portions assembled on the center hub portions and interlocking lever means releasably interlocking the rim portions with the hub portions, and means for activating the interlocking levers to release the hub portions to assume different angular positions relative to their companion rim portions to permit resetting of the lock to different combinations by resetting of relative positions of hub portions to their companion rim portions.

11. A lock as defined in claim 1, wherein the lock is a key lock operable by a key having an elongated shank and a plurality of wards projecting therefrom insertable into the center portions of the tumbler wheels, said tumbler wheels each including center hub portions having shaped key apertures defining surfaces shaped to coact with the key wards to dispose said gates in alignment to receive the fence responsive to predetermined manipulation of the key.

12. A lock as defined in claim 11, wherein said tumbler wheels each include peripherally gated outer rim portions assembled on the center hub portions and interlocking lever means releasably interlocking the rim portions with the hub portions, and means for activating the interlocking levers to release the hub portions to assume different angular positions relative to their companion rim portions to permit resetting of the lock to different key ward configurations by resetting of relative positions of hub portions to their companion rim portions.

13. A lock as defined in claim 1, forming a dial-operated combination lock, comprising a spingle rotatable about said common axis having said control cam on one end thereof and a manually operable dial on the other end for rotating the control cam to angularly adjust the tumbler wheels, and means providing a lost motion driving coupling between the control cam and the tumbler wheels.

14. A lock as defined in claim 13, wherein said tumbler wheels each include peripherally gated outer rim portions assembled on the center hub portions and interlocking lever means releasably interlocking the rim portions with the hub portions, and means for activating the interlocking levers to release the hub portions to assume different angular positions relative to their companion rim portions to permit resetting of the lock to different combinations by resetting of relative positions of hub portions to their companion rim portions.

* * * * *